US008840153B2

(12) United States Patent
Juha

(10) Patent No.: US 8,840,153 B2
(45) Date of Patent: Sep. 23, 2014

(54) UPPER LOCK SYSTEM OF A PASSIVE DOOR BLADE OF A DOUBLE DOOR

(75) Inventor: Raatikainen Juha, Kontiolahti (FI)

(73) Assignee: Abloy Oy, Joensuu (FI)

( * ) Notice: Subject to any disclaimer, the term of this patent is extended or adjusted under 35 U.S.C. 154(b) by 78 days.

(21) Appl. No.: 13/203,938

(22) PCT Filed: Mar. 23, 2010

(86) PCT No.: PCT/FI2010/050226

§ 371 (c)(1),
(2), (4) Date: Aug. 30, 2011

(87) PCT Pub. No.: WO2010/109068

PCT Pub. Date: Sep. 30, 2010

(65) Prior Publication Data

US 2011/0316292 A1 Dec. 29, 2011

(30) Foreign Application Priority Data

Mar. 27, 2009 (FI) ..... 20095325

(51) Int. Cl.

| | |
|---|---|
| ***E05C 1/10*** | (2006.01) |
| ***E05C 7/04*** | (2006.01) |
| ***E05C 9/18*** | (2006.01) |
| ***E05C 9/20*** | (2006.01) |
| *E05B 65/10* | (2006.01) |
| *E05B 65/06* | (2006.01) |
| *E05C 17/00* | (2006.01) |
| *E05C 19/00* | (2006.01) |
| *E05B 55/00* | (2006.01) |
| *E05C 9/04* | (2006.01) |
| *E05B 63/00* | (2006.01) |

(52) U.S. Cl.

CPC . *E05C 7/04* (2013.01); *E05B 55/00* (2013.01); *E05C 9/185* (2013.01); *E05C 9/04* (2013.01); *E05C 9/20* (2013.01); *E05B 63/0056* (2013.01)

USPC ..... 292/175; 292/92; 292/93; 292/94; 49/394

(58) Field of Classification Search

USPC ..... 292/175, 92, 93, 94; 49/394; 70/102

See application file for complete search history.

(56) References Cited

U.S. PATENT DOCUMENTS 570,213 A 10/1896 Amborn, Jr.
4,445,717 A * 5/1984 Imhoff ..... 292/177

(Continued)

FOREIGN PATENT DOCUMENTS

DE 2611359 A1 10/1977
EP 1 473 424 A1 11/2004

(Continued)

*Primary Examiner* — Carlos Lugo
*Assistant Examiner* — Faria Ahmad
(74) *Attorney, Agent, or Firm* — Muncy, Geissler, Olds & Lowe, P.C.

(57) ABSTRACT

The upper lock system of the passive door blade of a double door according to the invention comprises a bolt (19) arranged to be installed to the upper surface of the passive door blade and arranged to be controlled by means of a pull bar (9). The bolt is a part of the lock (18). The lock also has a power transmission connection part (23) for the interface part (17) of the upper lock system. The interface part comprises a grabber module (24), power transmission module (32, 34) and a spring (26). The grabber module (24) is arranged to linearly move between the extended position and the retracted position. A spring (26) is arranged to push the grabber module towards the extended position. The power transmission mechanism (32, 34) is operationally connected with the grabber module (4) and the power transmission connection part (23).

10 Claims, 3 Drawing Sheets

(56) References Cited

U.S. PATENT DOCUMENTS

| | | | | |
|---|---|---|---|---|
| 4,974,890 | A * | 12/1990 | Cohrs | 292/336.3 |
| 5,524,942 | A * | 6/1996 | Fleming | 292/34 |
| 5,702,134 | A | 12/1997 | Hsieh | |
| 6,641,183 | B2 * | 11/2003 | Brown | 292/92 |
| 7,887,107 | B2 * | 2/2011 | Shen | 292/92 |
| 7,896,407 | B2 * | 3/2011 | Di Vinadio | 292/92 |
| 7,946,080 | B2 * | 5/2011 | Ellerton et al. | 49/395 |
| 2008/0034818 | A1 | 2/2008 | Vinadio | |
| 2008/0135684 | A1 * | 6/2008 | Kunda et al. | 244/129.5 |
| 2008/0178530 | A1 | 7/2008 | Ellerton et al. | |

FOREIGN PATENT DOCUMENTS

| | | | |
|---|---|---|---|
| FR | 2 344 695 | A1 | 10/1977 |
| GB | 2 004 319 | A | 3/1979 |
| GB | 2 080 391 | A | 2/1982 |
| GB | 2 214 561 | A | 9/1989 |
| GB | 2 236 355 | A | 4/1991 |
| WO | WO 01/20626 | A2 | 3/2001 |

* cited by examiner

UPPER LOCK SYSTEM OF A PASSIVE DOOR BLADE OF A DOUBLE DOOR

FIELD OF INVENTION

The present invention relates to upper locking of the passive door blade of a double door.

BACKGROUND ART

Figure 1:
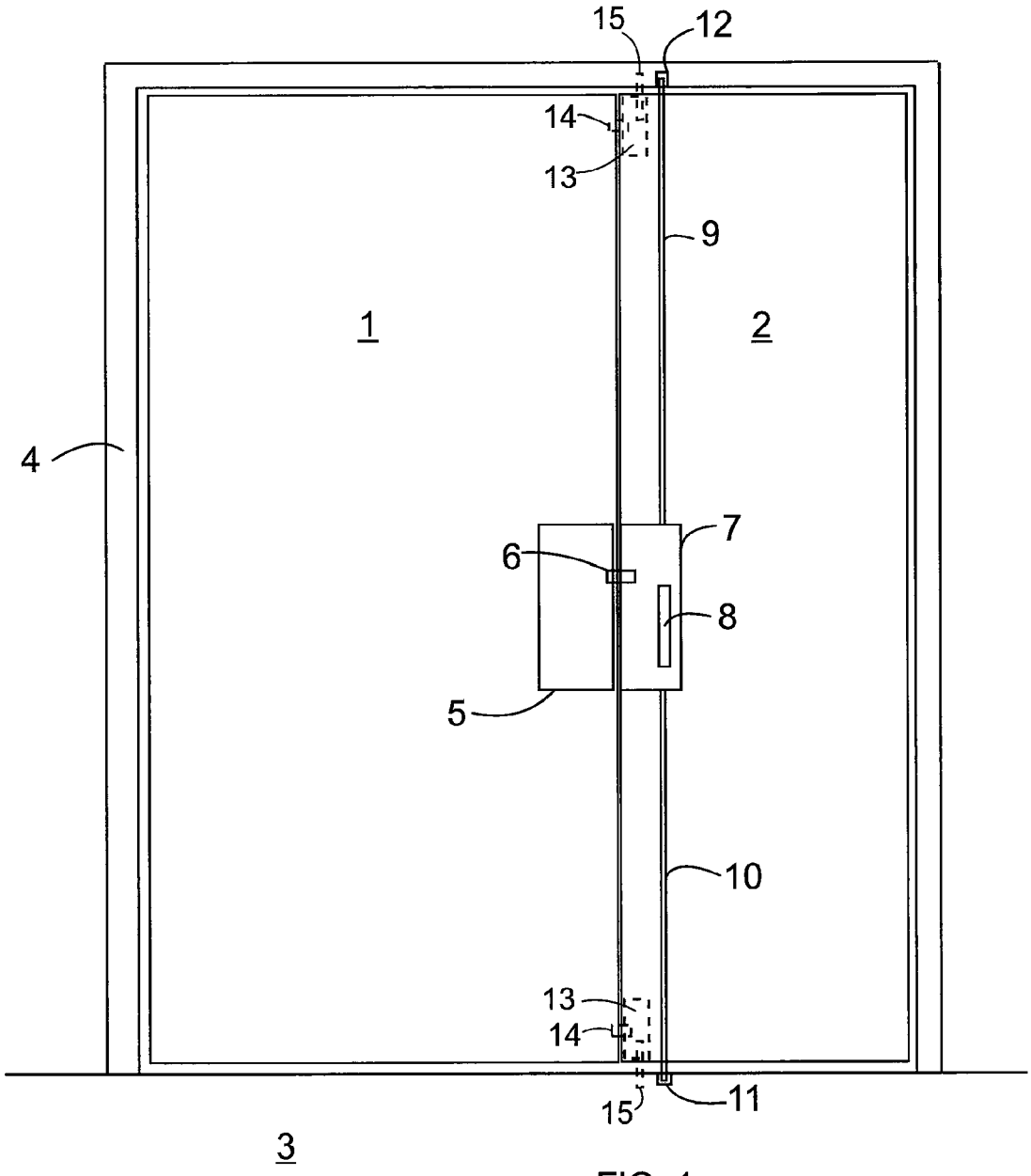

FIG. 1 illustrates two known ways of locking the passive door of a double door. The double door consists of an active door blade 1 and a passive door blade 2. The active door blade and the passive door blade are also called the active door and the passive door. The active door blade is the door for normal usage, used when the doorway is passed through when not carrying larger loads. In case larger items must be transported through the doorway, such as during moving, opening the active door blade does not necessarily form a large enough opening. In such case the passive door blade is opened as well. Usually the passive door blade is locked to the jamb structure 4 of the doorway and the floor level 3.

The active door blade 1 and the passive door blade 2 are rotatably attached to the jamb structure 4 of the doorway by means of hinges. Usually the active door blade 1 comprises a lock 5 comprising a bolt 6. When the active door 1 is locked, the bolt 6 is partially inside the striker lock body 7, thus locking the active door to the passive door. The striker lock body is also called a striker lock and vice versa, because in practice the body comprises the lock functions. Because the passive door 2 is locked to the jamb structure 4 of the doorway and the floor level 3, the passive door cannot rotate and neither can the active door locked to the passive door. It can be said that in normal use the passive door is a part of the jamb structure of the doorway 4. The locking of the active door 1 is released normally and the door is opened normally.

The striker lock body 7 is combined with pull bars 9, 10 installed in the passive door 2 and locking the passive door to the jamb structure of the doorway and the floor. Recesses 12, 11, into which the ends of the pull bars are located when the passive door is locked, are arranged in the jamb structure 4 and the floor level 3. A release means 8 is arranged in the striker lock body for pulling the pull bars towards the inside of the passive door so that the ends of the pull bars move away from the recesses 11, 12 of the frame structure and the floor level. The name of the pull bars is derived from this action. When the pull bars are pulled inside the passive door, the passive door can be opened, i.e. rotated. A typical release means 8 comprises a hand-turnable lever. In some known solutions the release means 8 is not located in connection with the striker lock body of the passive door but instead it is formed as a separate unit being in connection with the pull bars. The pull bars can also be moved back to the protruding position away from the inside of the passive door by means of the release means 8, whereby the passive door can be locked back to the jamb structure and the floor level.

Another way of locking the passive door is by using separate locks in the upper edge and/or lower edge of the passive door blade. FIG. 1 illustrates an embodiment in which both the upper edge and the lower edge of the passive door blade comprise a lock 13. The lock comprises a latch 15 that is in protruded position when the door is locked. The latch of the upper lock 15 locks the passive door to the frame 4 while the latch 15 of the lower lock locks the door to floor level 3. The locking of the doors is released when the active door blade is opened, whereby the control wedge 14 of the lock 13 can move out. The protrusion of the control wedge directs the latch 15 to the inside of the lock, whereby the passive door can be opened. The locking is effected when the active door is turned against the passive door, whereby the control wedge is depressed to inside the lock and simultaneously directs the latch 15 from the lock.

The problem with the upper and lower lock is that the control wedge 14 resists closing and opening the active door. The lock 13 has a spring/a spring system pressing the control wedge out from the lock. The control wedge then presses the active door. This reduces the ease of use of the active door. Further, if the active door is combined with door automatics, the lock 13 can also resist the operation of the door opening/closing apparatus.

Patent publication WO 2006117457 also discloses a known method for locking the passive door blade of a double door. The solution of the publication shows a design in which the ends of the pull bars (cf. FIG. 1) are provided with a locking bolt system. When the pull bar is pulled inside, the bolt can turn and the passive door can be opened. The end of the pull bar is also provided with a spring pushing the pull bar outwards. When the passive door is closed, the bolt turns and the spring can push the bolt outwards to locking position. Installing this solution is fairly difficult, as the pull bar must be cut quite precisely before installation and it is fastened to the locking bolt system before installation. The pull bar must also be removed from the passive door in connection with any service work or replacement.

BRIEF DESCRIPTION OF THE INVENTION

The object of the invention is to produce an upper lock system for a passive door blade that provides as little disadvantages to the use of the active door as possible and that is easy to install and service. The aim is achieved as described in the independent claim. The dependent claims describe the various embodiments of the invention.

The upper lock system for a passive door blade of a double door according to the invention comprises a bolt 19 arranged to be installed in the upper surface of the passive door blade and that is also arranged to be controlled by means of a pull bar 9. The bolt is a part of the lock 18. The lock also has a power transmission connection part 23 for the interface part 17 of the upper lock system. The interface module comprises a grabber module 24, a power transmission mechanism 32, 34 and a spring 26. The grabber module 24 is arranged to move linearly between an extended position and a retracted position. A resilient means 26 is arranged to push the grabber module towards the extended position.

The power transmission mechanism 32, 34, is operationally connected to the grabber module 24 and the power transmission connection part 23. The position of the power transmission mechanism 32, 34 depends on the position of the grabber module 24. In the retracted position the grabber module 24 is arranged to form a connection to the pull bar 9, and the lock 18 is in open state. In the extended position the grabber module 24 is arranged to maintain the connection between the pull bar 9 and the grabber module 24, and the lock 18 is in the locked state. In the extended position the connection can also be released.

LIST OF FIGURES

Figure 2:
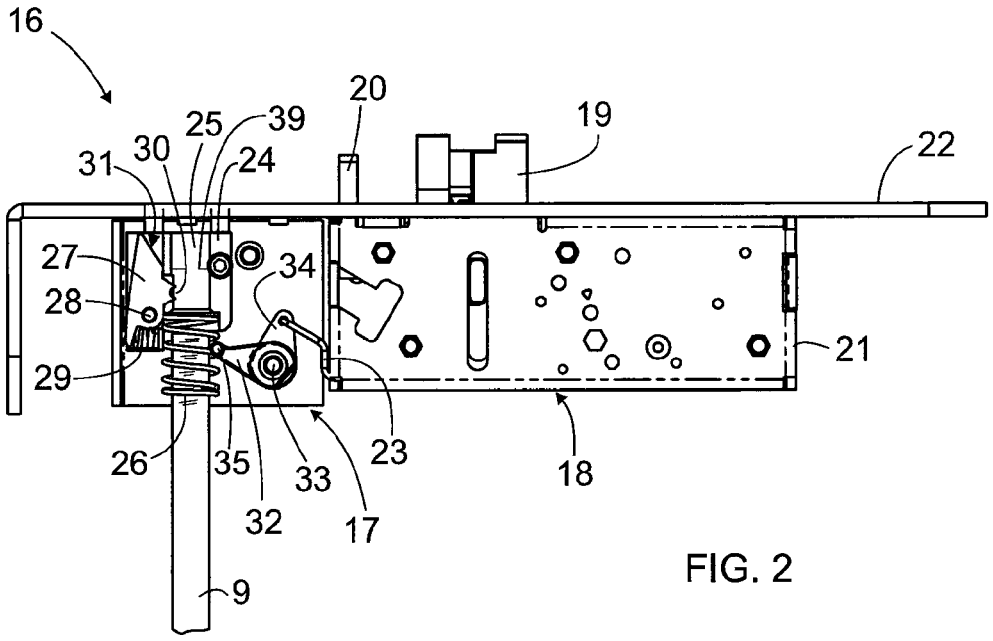
Figure 3:
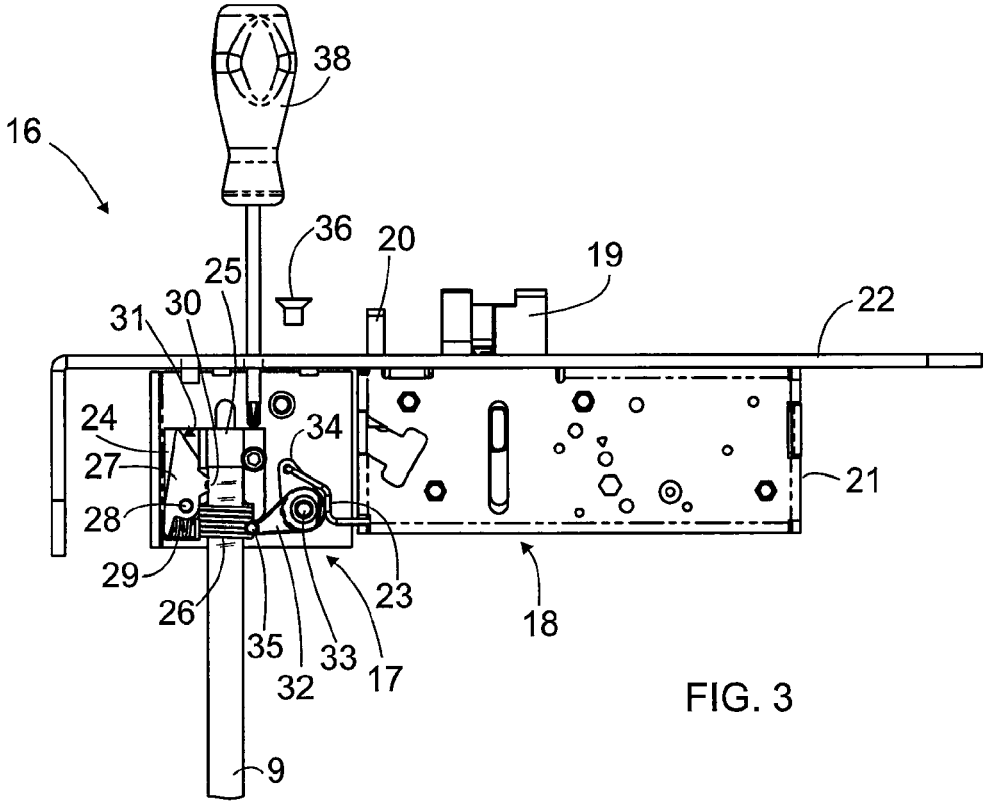
Figure 4:
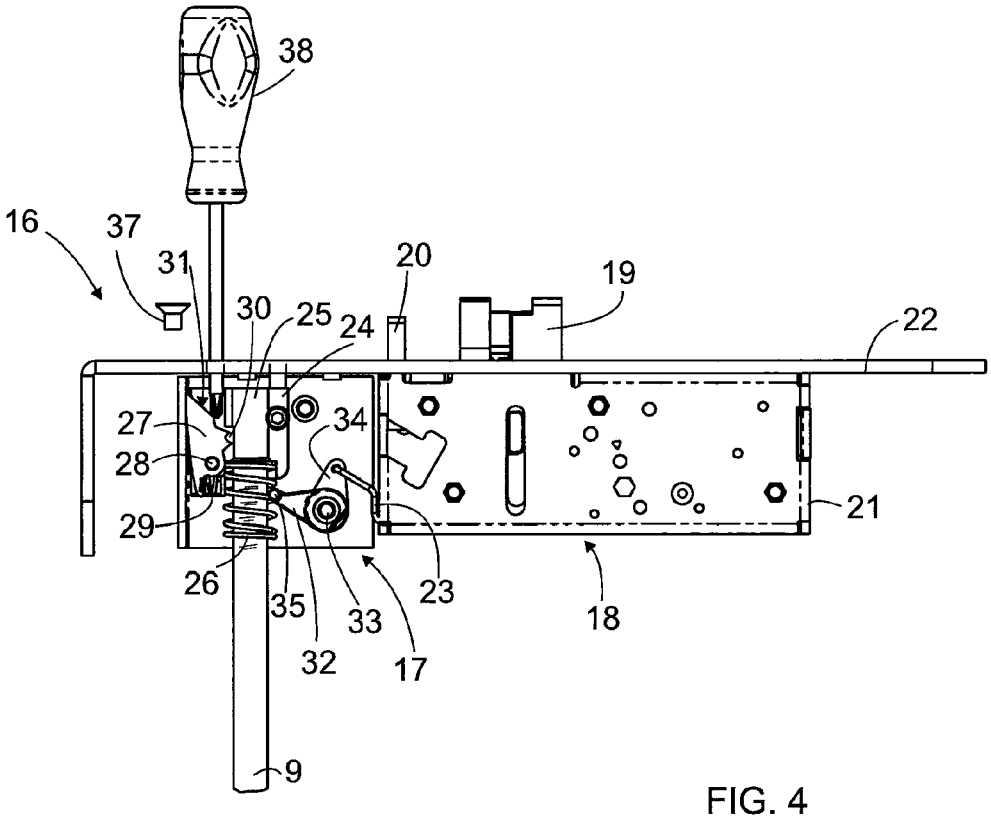
Figure 5:
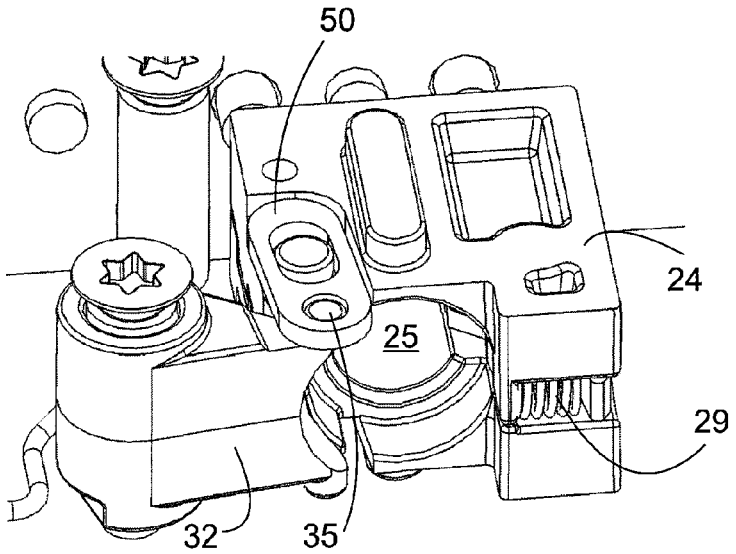

In the following the invention is described in more detail by reference to the appended figures, in which FIG. 1 shows examples of known ways to lock a passive door, FIG. 2 shows an example of an upper lock system according to the invention, FIG. 3 shows an example of an upper lock system according to the invention when the pull bar is fastened to the upper lock system, FIG. 4 shows an example of an upper lock system according to the invention when the pull bar is released from the upper lock system and FIG. 5 exemplifies the structures of the interface part.

DESCRIPTION

FIG. 2 shows an example of the upper lock system 16 of the passive door blade of a double door according to the invention. The system consists of two main parts: the lock 18 and the interface part 17. The basic design of the lock is that of a normal door lock installed in the upper edge of a passive door instead of the side edge of a door. The lock is also provided with a power transmission part 23 for opening and locking the lock from outside the lock body 21. The bolt 19 of the lock 18 is the part locking the passive door blade to the jamb structure of the doorway. The lock can also be provided with a control wedge 20 depending on the lock model.

The power transmission part 23 is in connection with the interface part 17. The interface part comprises a grabber module 24, a power transmission mechanism 32, 34 and a spring 26. The grabber module 24 is arranged to move linearly between an extended position and a retracted position. In the extended position (FIG. 2) the grabber module is nearer to the front plate 22 of the system and in the retracted position (FIG. 3) the grabber module is in the vicinity of the rear edge of the body of the interface part. A resilient means 26 is arranged to push the grabber module towards the extended position.

The power transmission mechanism 32, 34, is operationally connected to the grabber module 24 and the power transmission connection part 23. The position of the power transmission mechanism 32, 34 depends on the position of the grabber module 24.

In the retracted position the grabber module 24 is arranged to form a connection to the pull bar 9, and the lock 18 is in open state. In open state the bolt 19 is allowed to be inserted inside the lock body 21. In the extended position the grabber module 24 is arranged to maintain the connection between the pull bar 9 and the grabber module 24, and the lock 18 is in the locked state. In closed state the bolt 19 cannot be pushed inside the lock body. In extended position the connection between the pull bar and the grabber module is additionally releasable.

The grabber module 24 comprises a chamber 25 for the pull bar and grabber piece 27. The grabber piece is rotatably connected 28 to the body of the grabber module 24. The connection can be provided by means of, e.g. an axle stub. The grabber piece is provided with a grabbing extension 30 for grabbing the pull bar. The grabber module 24 also comprises a second resilient means 29 arranged to rotate the grabbing extension 30 of the grabber piece towards the chamber 25 reserved for the pull bar.

The grabber piece 27 also comprises a surface, a so-called release surface 31, for rotating the grabbing extension 30 of the grabber piece away from the chamber 25. The front plate 22 has a screw hole for screw 37 at the location of the grabber module 24 (FIG. 4). Tool 38 can be inserted through the screw hole to the inside of the interface part against the release surface 27 and its grabbing extension 30 could be turned to face away from the chamber 25. Preferably the release surface is arranged slanted in relation to the front plate 22 to make it easier to turn the grabber piece 27 by means of the tool.

The resilient means 26 is e.g. a spring, the first end of which is supported by the body of the interface part 17 and the second end is supported by the grabber module 24. In the example of the figures the spring is a compression spring the middle part of which is arranged as an extension of chamber 25. Thus the pull bar can be positioned into the chamber 25 via the center chamber of the compression spring. The spring can also be a spring of another shape, such as a V-shaped torsion spring.

The front plate 22 also has a screw hole for the screw 36 at the location of the grabber module 24 (FIG. 3). The grabber module can be moved towards the retracted position through this hole by means of the tool 38 against the spring force of the resilient means. When the tool is moved from the interface part, the resilient means pushes the grabber module to extended position.

In the following the system according to the invention is described by means of reference to the embodiment of the figures. The pull bar 9 installed in the passive door prior to the upper lock system is not attached to the grabber module in the situation of FIG. 2, when the end of the bar is below in the center chamber of the compression spring 26. When the grabber module is pushed to the retracted position with a suitable tool, the spring 26 is cocked by compression and the grabbing extension 30 of the grabber piece 27 catches the pull bar. At this stage the end of the pull bar is in state 25. FIG. 3 shows this situation. Usually the pull bar is a threaded bar, i.e. the surface of the bar comprises external threads which the grabbing extension catches. The grabbing extension 30 has at least one tip for catching the threads. The embodiment shown in the figure comprises two tips. The resilient means 29 tends to rotate the grabber piece 27 so that the grabbing extension 30 is pushed against the threaded bar. When the tool is removed from the interface part 17, the resilient means 26 pushes the grabber module 24 to extended position simultaneously lifting the pull bar 9 as the grabber piece 27 fastens the end of the pull bar to the chamber 25 arranged in the grabber module. The grabber module 24 is thereby in the position shown by FIG. 2 and the end of the pull bar is in chamber 25, as shown by dotted line 39.

When it is desired to release the pull bar from the upper lock system the release surface 31 of the grabber piece is pushed with a suitable tool through the screw hole located at the release surface. Thereby the grabber piece 27 and its grabbing extension 30 are rotated away from the pull bar, whereby the connection between the grabber module 24 and the pull bar 9 is released and the pull bar is allowed to move downwards. FIG. 4 illustrates such a release situation. When the tool is removed from the interface part 17, the upper lock system in the state shown FIG. 2.

The power transmission mechanism 32, 34 is rotatably attached 33 to the body of the interface part 17. The connection can be carried out by means of, e.g. an axle stub. The power transmission mechanism comprises a first protrusion 34 and a second protrusion 32. The first protrusion 34 is connected to the power transmission connector part 23 and the second protrusion 32 is operationally connected to the grabber module 24. In the example shown in the figures the second protrusion of the power transmission 32 comprises a counter surface 35 operationally located against the grabber module 24. The counter surface is e.g. a cylindrical surface. When the grabber module 24 is in the extended position the spring 29 is in its most extended state and the power transmission mechanism is also turned into such a position in which the power transmission connection part 23 connected to the protrusion 34 has controlled the lock 18 to locked state. When the grabber module 24 is in the retracted position the spring 29 is in its shortest state and the power transmission mechanism is also turned into such a position in which the power transmission connection part 23 connected to the first protrusion has controlled the lock 18 to open state.

In the illustrated embodiment the connection between the power transmission mechanism and the grabber piece is arranged so that it does not obstruct the operation of the resilient means 26, i.e. the compression spring in the embodiment of the figures. FIG. 5 shows an embodiment for achieving the connection. The embodiment of FIG. 5 uses a separate piece 50. The power transmission mechanism can also be arranged in direct connection with the grabber module 24. FIG. 5 also illustrates the design of the grabber module.

The front plate 22 of the upper lock system can be L-shaped, as shown in figures, but it can also be straight. The lock 18 can also be electrically controlled, whereby the invention also makes it possible to arrange an electric control for the upper locking. Thus the upper locking can be combined with the automatics, if any, of the double door.

In light of the above examples it is obvious that the embodiment according to the invention can be realized in a number of ways. It is obvious that the invention is not limited to the examples mentioned here, but that the invention can be realized by a number of different embodiments within the appended claims.

The invention claimed is:

1. An upper lock system of a passive door blade of a double door, the system comprising a bolt arranged to be installed to an upper surface of the passive door blade and arranged to be controlled by means of a pull bar, wherein the system comprises a lock and an interface part, the lock comprising said bolt and a power transmission connection part for the interface part, the interface part comprising a grabber module, a power transmission mechanism and a resilient means, the grabber module being arranged to linearly move between an extended position and a retracted position and the resilient means being arranged to push the grabber module towards the extended position, the power transmission mechanism being operationally connected to the grabber module and the power transmission connection part, a position of the power transmission mechanism depending on a position of the grabber module, in which retracted position the grabber module being arranged to form a connection to the pull bar and the lock being in open state, and in which extended position the grabber module being arranged to maintain the connection between the pull bar and the grabber module and the lock being in the locked state, the connection additionally being disengageable in the extended state, wherein the grabber module comprises a grabber piece and a chamber for the pull bar, the grabber piece being rotatably connected to the body of the grabber module and the grabber niece comprising a grabber extension for catching the pull bar, the grabber module additionally comprising a second resilient means arranged to rotate the grabber extension of the grabber piece towards the chamber.

2. The upper lock system according to claim 1, wherein the grabber piece comprises a release surface, and wherein the release surface is configured to receive an external force and under the external force the grabbing extension of the grabber piece is rotated away from the chamber.

3. The upper lock system according to claim 2, wherein the resilient means is a spring, a first end of which is supported by the body of the interface part, another end being supported by the grabber module.

4. The upper lock system according to claim 1, wherein the power transmission mechanism is rotatably attached to the body of the interface part and the power transmission mechanism comprises a first protrusion and a second protrusion, the first protrusion being connected to the power transmission connection part and the second protrusion being operationally connected to the grabber module.

5. An upper lock system of a passive door blade of a double door, the system comprising a bolt arranged to be installed to an upper surface of the passive door blade and arranged to be controlled by means of a pull bar, wherein the system comprises a lock and an interface part, the lock comprising said bolt and a power transmission connection part for the interface part, the interface part comprising a grabber module, a power transmission mechanism and a resilient means, the grabber module being arranged to linearly move between an extended position and a retracted position and the resilient means being arranged to push the grabber module towards the extended position, the power transmission mechanism being operationally connected to the grabber module and the power transmission connection part, a position of the power transmission mechanism depending on a position of the grabber module, in which retracted position the grabber module being arranged to form a connection to the pull bar and the lock being in open state, and in which extended position the grabber module being arranged to maintain the connection between the pull bar and the grabber module and the lock being in the locked state, the connection additionally being disengageable in the extended state, wherein the power transmission mechanism is rotatably attached to the body of the interface part and the power transmission mechanism comprises a first protrusion and a second protrusion, the first protrusion being connected to the power transmission connection cart and the second protrusion being operationally connected to the grabber module, and wherein the spring is a compression spring, a center chamber of which is arranged as an extension of the chamber.

6. The upper lock system according to claim 5, wherein the second extension of the power transmission mechanism comprises a counter surface being operationally connected to the grabber module.

7. The upper lock system according to claim 1, wherein the grabber extension comprises at least one tip for catching the pull bar.

8. The upper lock system according to claim 2, further comprising a front plate having screw holes at the location of the grabber module and the release surface of the grabber piece.

9. The upper lock system according to claim 8, wherein the front plate is L-shaped.

10. The upper lock system according to claim 1, wherein the lock comprises a control wedge.

* * * * *